United States Patent [19]

Nitschko et al.

[11] 4,456,281

[45] Jun. 26, 1984

[54] HEEL HOLDER

[75] Inventors: Theodor Nitschko, Vienna; Engelbert Spitaler, Wr. Neudorf, both of Austria

[73] Assignee: TMC Corporation, Baar, Switzerland

[21] Appl. No.: 409,472

[22] Filed: Aug. 19, 1982

[30] Foreign Application Priority Data

Aug. 20, 1981 [AT] Austria ..... 3650/81

[51] Int. Cl.[3] ..... A63C 9/08

[52] U.S. Cl. ..... 280/628

[58] Field of Search ..... 280/628, 630, 623

[56] References Cited

U.S. PATENT DOCUMENTS

| | | | |
|---|---|---|---|
| 3,476,401 | 11/1969 | Unger | 280/628 |
| 3,580,597 | 5/1971 | Beyl | 280/628 |
| 3,920,256 | 11/1975 | Sittmann | 280/628 X |
| 4,111,453 | 9/1978 | Krob | 280/626 |
| 4,243,246 | 1/1981 | Weigl | 280/628 |
| 4,358,132 | 11/1982 | Beyl | 280/628 |

FOREIGN PATENT DOCUMENTS

| | | | |
|---|---|---|---|
| 2340420 | 2/1975 | Fed. Rep. of Germany | 280/628 |
| 2535528 | 2/1977 | Fed. Rep. of Germany | . |
| 2637871 | 3/1978 | Fed. Rep. of Germany | 280/628 |
| 2482864 | 11/1981 | France | 280/628 |

*Primary Examiner*—Joseph F. Peters, Jr.
*Assistant Examiner*—Mitchell J. Hill
*Attorney, Agent, or Firm*—Flynn, Thiel, Boutell & Tanis

[57] ABSTRACT

A heel holder of a ski binding includes a base plate supported on a ski, a housing pivotally supported on the base plate, and a release lever pivotally supported on the housing by a horizontal axle. The release lever has a cam and a locking member movably supported in the housing is urged against the cam by a release spring. A connecting member has a slotlike opening in one end through which a transverse axle provided on the release handle extends. A unit having a stepping spur and sole hold-down is pivotally supported on the opposite end of the connecting member. A compression spring disposed in a blind hole in the release lever and cooperable with the first end of the connecting member urges it outwardly, and torsion springs provided on the transverse axle urge the unit to swing upwardly.

19 Claims, 5 Drawing Figures

Fig.3
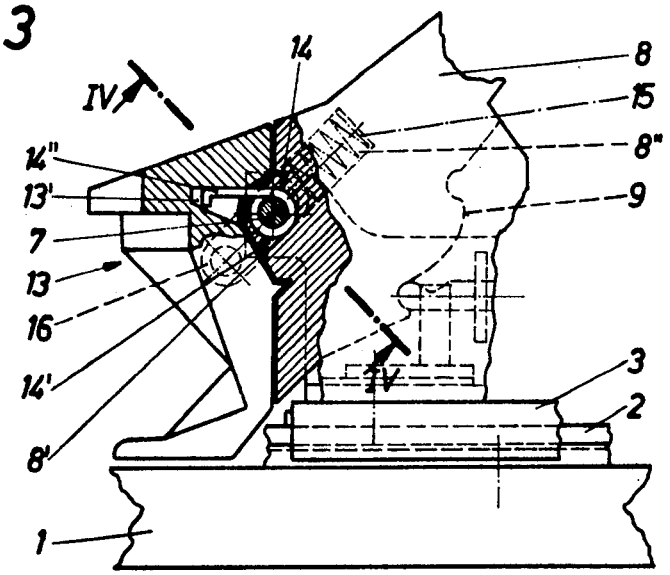
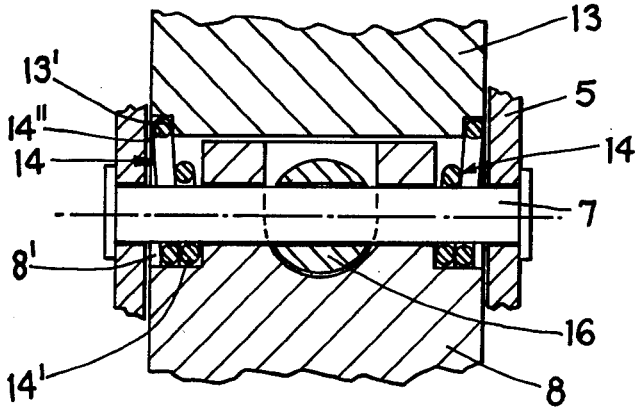
FIG. 4

HEEL HOLDER

FIELD OF THE INVENTION

This invention relates to a heel holder for a ski binding and, more particularly, to a heel holder having a base plate which can be secured on the ski or which is adjustably supported for movement in the longitudinal direction of the ski and can be releasably secured at a selected position, on which base plate is arranged a housing having therein a release spring and a locking member and, if desired, being supported for pivotal movement relative to the base plate about an axis which is normal to the upper side of the ski and supporting on a transverse axle a unit which has a stepping spur and a down-holding part, with which unit is associated a release lever which has a cam.

BACKGROUND OF THE INVENTION

One heel holder of this type is very simple in its construction and is extremely sturdy, but has the disadvantage that, in the case of an automatic release of the front jaw of the ski binding, the release lever, which is constructed with an integral stepping spur and down-holding part, must be manually swung back to the stepping-in position before the ski shoe can step in again.

Heel holders have already been suggested which are always ready for a ski shoe to step in, regardless of whether the heel holder was released voluntarily or released automatically, or whether a release took place only at the front jaw (see, for example, Austrian Pat. No. 341 393, which corresponds to U.S. Pat. No. 4,111,453). These heel holders, however, are somewhat expensive to construct.

A goal of the invention is therefore to overcome the mentioned disadvantages and to produce a heel holder of the mentioned type which, on the one hand, is ready for a stepping in of the ski shoe after any kind of a release and, on the other hand, is extremely simple in its design.

SUMMARY OF THE INVENTION

This goal is achieved inventively by providing a heel holder of the mentioned type in which the unit which has the stepping spur and down-holding part and which in the downhill skiing position preferably engages the release lever along a separating plane is hingedly coupled to the release lever and is biased by at least one first spring which urges it to pivot upwardly and by at least one second spring which urges the unit away from the transverse axle and away from the release lever.

It has proven particularly advantageous if, according to a further characteristic of the invention, the hinged coupling of the unit with the release lever is effected by at least one connecting member having an opening therein through which the transverse axle of the release lever extends and which is constructed as a slot, a further transverse axle on the unit extending through a further opening in the connecting member.

In order to achieve, particularly during the initial phase of the combined movement of the unit which has the stepping spur and down-holding part, rapid acceleration, the invention further provides that the second spring is a compression spring and is disposed in a blind hole in the release lever, the axis of which hole is aligned with the axis of the connecting member in the downhill skiing position of the heel holder, and which hole is constructed with a shape at its outer end, for example circular or rectangular, which corresponds to the cross-sectional shape of the connecting member. Therefore, during a release of the binding, movement of the unit away from the release lever is assured even when the heel holder is dirty or is contaminated with ice crystals.

It has proven advantageous for a particularly compact construction if, inventively, the transverse axle for the release lever is supported in bearing eyes provided in projections which are provided on the release lever and project across the separating plane between the unit and the release lever and into recesses provided in the unit.

At times, relative movement might occur between the mentioned unit and the release lever during skiing, which could result in wearing out the coupling. In order to reliably prevent such movement, the unit is inventively provided with at least one projection which, in the downhill skiing position of the heel holder, is received in a recess provided in the release lever below the projections having the two bearing eyes.

Furthermore, the invention provides that, for limiting the combined movement of the unit and the connecting member relative to the release lever, stop surfaces are provided on the latter. With this, the angle of pivotal movement of the unit is preferably limited to approximately 36° and that of the connecting member to approximately 72°.

Of course, various arrangements of first springs which are torsion springs and cause the swivelling movement of the unit relative to the release lever are possible. However, it has proven particularly structurally simple if each torsion spring is supported on the transverse axle for the release lever, one leg of each torsion spring being supported on a stop surface on the release lever, and the other leg having a bent end which is disposed in a slotlike recess in the unit. A smooth sliding of such leg in the longitudinal direction in the recess during the combined movement of the unit is thereby made possible by its bent end.

For the arrangement of the torsion springs, of course, various solutions are possible. However, it has proven particularly advantageous if the connecting member and compression spring are arranged in the center region of the release lever, symmetrically with respect to its vertical longitudinal center plane, the two torsion springs being on opposite sides of and spaced from the connecting member.

BRIEF DESCRIPTION OF THE DRAWINGS

One exemplary embodiment of the invention is illustrated in the drawings, in which:

FIG. 3 is a fragmentary elevational side view of the heel holder of FIG. 1 in the downhill skiing position;

FIG. 4 is a sectional view taken along the line IV—IV of FIG. 3; and

DETAILED DESCRIPTION

Figure 2:
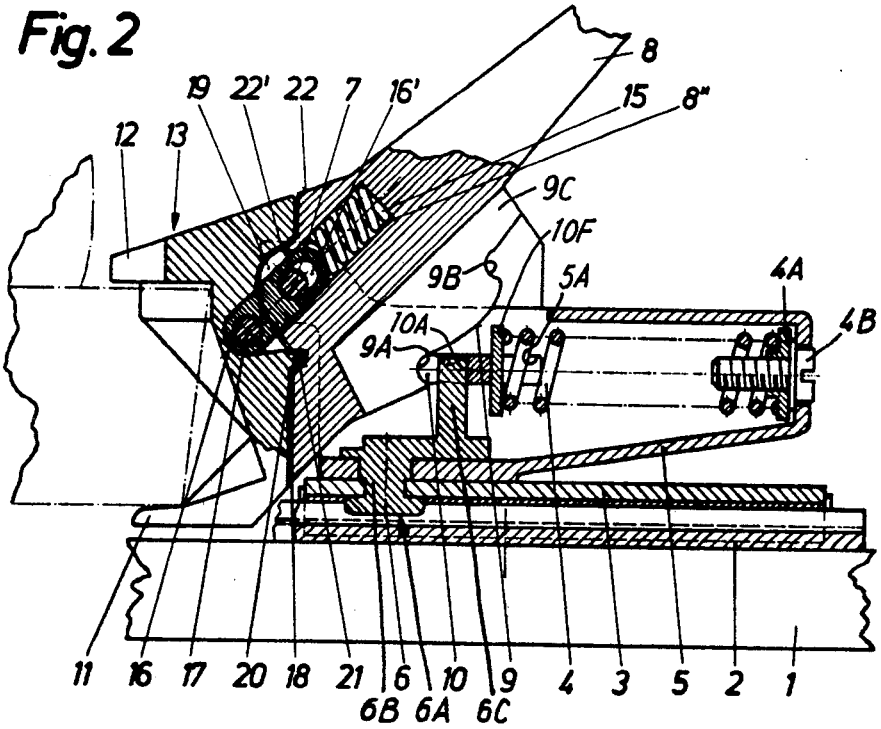
FIG. 2 is a fragmentary, longitudinal sectional view similar to FIG. 1 but showing the heel holder in the downhill-skiing position.
Figure 1:
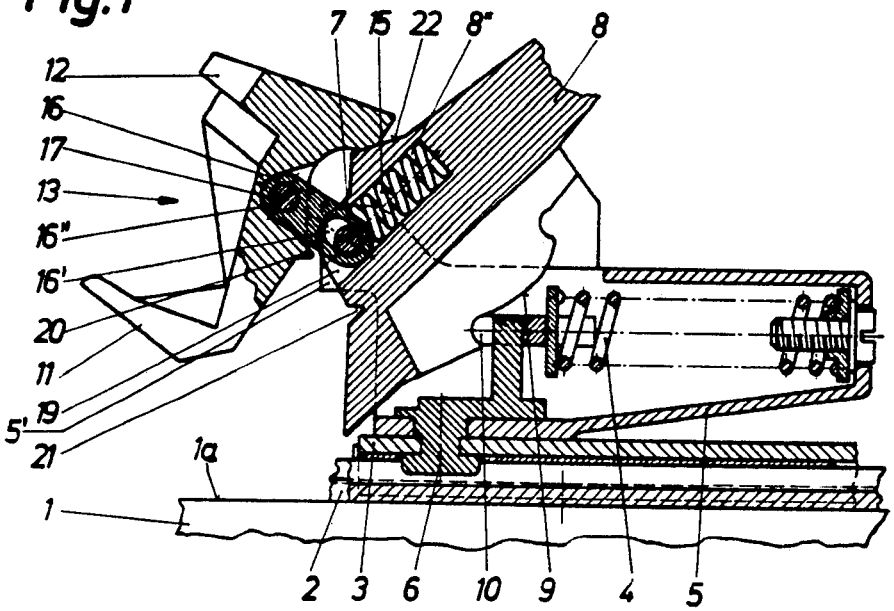
FIG. 1 is a fragmentary, longitudinal, sectional view of an inventive heel holder in a stepping-in position.

Reference numeral 1 identifies a ski in FIGS. 1 and 2, on the upper side 1*a* of which is secured a guide rail 2. The base plate 3 of a heel holder is movably supported on the guide rail 2. Base plate 3 can be fixed in a conventional manner, by means which are not illustrated, in a selected position along guide rail 2. A housing 5, which has therein a release spring 4 and a locking member 10, is supported for pivotal movement about a vertical axis 6 on the base plate 3. The housing 5 has near its end which faces the ski shoe two projections 5' having bearing eyes therein, in which bearing eyes is arranged a transverse axle 7 which pivotally supports a release lever 8. The release lever 8 has a cam 9 on its underside which cooperates with the locking member 10, which is biased by the release spring 4, and is supported for movement in the housing 5 in the direction of the axis of the spring.

The arrangement of housing 5, pivot element 6A, locking member 10, spring 4, spring abutment 4A, screw 4B and the cam 9 on release lever 8 is substantially identical to that disclosed in U.S. Pat. No. 4,411,446, which issued on Oct. 25, 1983, the disclosure of which is incorporated herein by reference. A detailed discussion of this structure is therefore unnecessary, but a brief discussion is included in order to facilitate a more complete understanding of the present invention.

Figure 5:
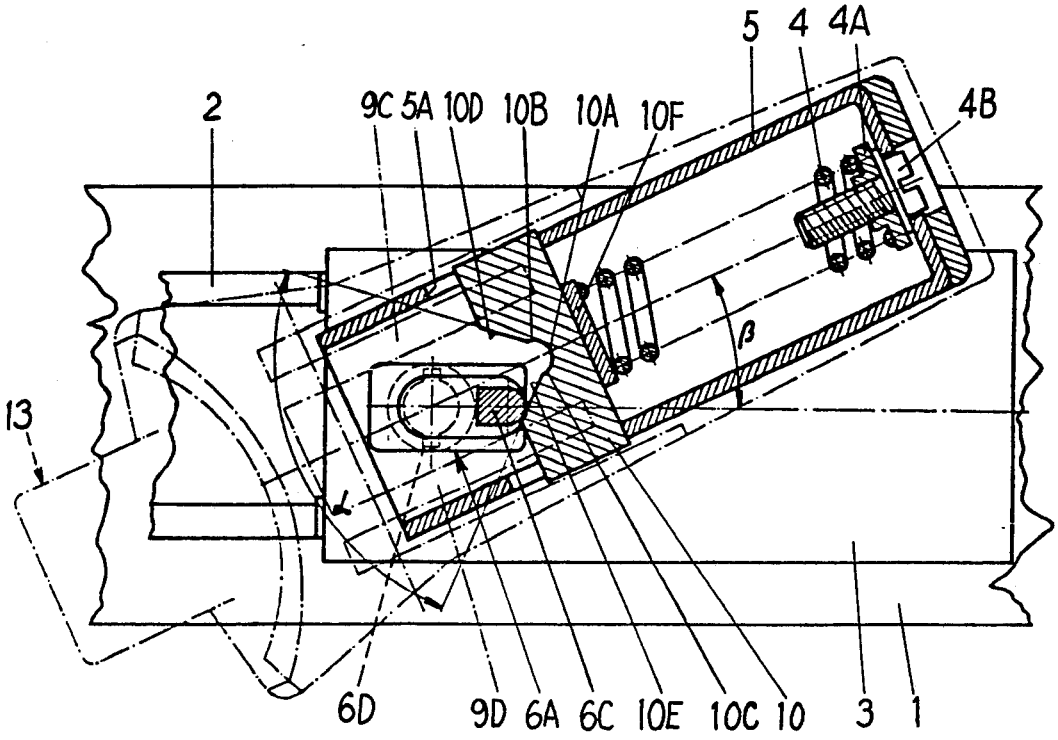
FIG. 5 is a fragmentary sectional top view of the heel holder of FIG. 1 in a different operational position.

Referring to FIGS. 2 and 5, the housing 5 is supported for pivotal movement about the axis 6 by means of pivot element 6A which has a portion 6B extending through aligned openings in the housing 5 and base plate 3. The opening in the housing and the corresponding surface on the member 6A are preferably circular, so that the housing 5 can pivot relative to the element 6A. The element 6A is fixed against rotation with respect to the base plate 3 by radially projecting extensions 6D thereon which are received in recesses in the base plate 3.

The locking member 10 is a generally horizontal plate slidably supported in horizontal slots 5A provided in the side walls of the housing 5. The release spring 4 has its ends supported on a spring abutment 10F provided on the locking member 10 and on a spring abutment 4A threadedly engaging a screw 4B. The spring urges the locking member 10 forwardly within the slot 5A, and the tension of the spring 4 can be adjusted by rotating the screw 4B. The locking member 10 has a generally V-shaped notch in the front edge thereof which includes two side surfaces 10D and 10E which converge rearwardly at an angle $\alpha$ and converge in the center of the notch in a rounded recess 10A, the side surfaces 10B and 10C of which extend substantially parallel to the longitudinal axis of the ski 1.

The pivot element 6A has an upright post 6C thereon which is received in the notch in the locking element 10, the rearwardly facing surface of the post 6C being rounded and having a radius substantially equal to that of the rounded recess 10A in the notch.

The cam surface 9 on the lever 8 is provided on two laterally spaced projections 9C and 9D which engage the front edge of the locking member 8 on opposite sides of the V-shaped notch.

The release lever 8 supports on its front side a hold-down unit 13 which includes a stepping spur 11 and a down-holding projection 12. The unit 13 is pivotally supported on the release lever 8 in a manner described below, is biased by two torsion springs 14 (FIG. 3) which urge the unit 13 to swivel upwardly, and is biased by at least one helical compression spring 15 which urges the unit 13 away from the transverse axle 7 and the release lever 8. The connection between the unit 13 and the release lever 8 is effected by a connecting member 16 having an opening 16' therein through which the transverse axle 7 extends and which is constructed as a slot. A transverse axle 17 of the unit 13 extends through a recess in the unit 13 and through a hole 16'' provided at the opposite end of the connecting member 16.

Of the springs 14 and 15, the latter is disposed in a blind opening or hole 8'' provided in a central region of the release lever 8, the axis of which in the skiing position of the heel holder is aligned with the longitudinal axis of the member 16 and, at its front or outer end, is constructed in a manner which corresponds to the shape of the associated end of connecting member 16 and permits swivelling movement thereof. This construction assures satisfactory guiding of the member 16 in the hole 8'', regardless of whether the member 16 has, as illustrated in FIG. 4, a circular cross section or, for example, is manufactured from a steel bar having a rectangular shape. The two torsion springs 14 are provided on opposite sides of the member 16, as shown in FIG. 3, and are supported on the transverse axle 7 for the release lever 8. One leg 14' of each torsion spring 14 is supported on a stop surface 8' on the release lever 8, and the other leg 14'' thereof extends into a slotlike recess 13' (FIGS. 3 and 4) in the unit 13. The end of the leg 14'' has an arc-shaped bend in order to make it slide in the recess 13' more easily.

In the downhill skiing position of the heel holder, a surface on the unit 13 contacts a surface on the release lever 8 along a separating plane 18. Projections 19 on the lever 8 have bearing eyes therein for the transverse axle 7 and extend forwardly across the separating plane 18. Furthermore, the unit 13 has a projection or ridge 20 which, in the skiing position of the heel holder, is received in a recess 21 provided in the release lever 8 below the two projections 19. The projection 20 in this position extends to the side of the separating plane 18 opposite from the two bearing eyes in the projections 19. Finally, stop surfaces 22 and 22' are provided on the release lever 8 and respectively limit the angle of pivotal movement of the unit 13 about axle 17 and of the member 16 about axle 7. The maximum pivot angle is preferably about 36° for the unit 13 and about 72° for the member 16.

The cam 9 on the release lever 8 includes two spaced notches 9A and 9B. In the downhill skiing position, the end of the locking member 10 engages the notch 9A, as shown in FIG. 2.

The inventive heel holder operates as follows. In the skiing position of the heel holder, the unit 13 is firmly urged toward the release lever 8 against the force of the springs 14 and 15 by a ski boot releasably held between the front and rear jaws of the ski binding. The two parts thus contact one another along the separating plane 18 as shown in FIG. 2. During a voluntary release of the heel holder, the release lever 8 is manually swivelled out of the downhill skiing position about the transverse axle 7 toward the upper side 1*a* of the ski. The locking member 10 thereby slides out of notch 9A and along the cam 9 of the release lever 8 toward notch 9B, the release spring 4 simultaneously being slightly compressed within the housing 5 as the member 10 is moved to the right.

An analogous operation takes place in an automatic release of the heel holder, during which, due to a force which acts upwardly through the heel of the ski shoe onto the down-holding part 12, which heel is indicated in FIG. 2 by dash-dotted lines, the release lever 8 is swung clockwise in FIG. 2, causing sliding of the locking bolt 10 along the cam 9 of the release lever 8 and thus a compression of the release spring 4 in the housing 5. In both release operations, the unit 13 remains in contact with the release lever 8 in the manner shown in FIG. 2 until the ski shoe has left the heel holder. This is achieved through the projection 20 on the unit 13, which is received in the recess 21 in the release lever 8.

If a purely lateral release force is applied to the hold-down unit 13 by a ski boot, the post 6C will be held immovable in the recess 10A of the V-shaped notch by the surfaces 10B and 10C which extend substantially parallel to the longitudinal axis of the ski 1. Thus, a lateral release effected by pivotal movement of the housing 5 about the axis 6 can occur only if a release force having a lateral component also includes an upward component which causes the cam surface 9 to move the locking member 10 rearwardly against the force of the spring 4 until the post 6C is free of the recess 10A. This helps to prevent an automatic release which is unintended or inadvertent.

When only the front jaw of the ski binding, which jaw is not illustrated, automatically releases and the ski shoe leaves the binding, the unit 13 is urged away from the lever 8 due to the spring 15 and also away from the separating plane 18, and only then does any swivelling movement become possible. Then, the unit 13 is swung clockwise under the urging of the two torsion springs 14 (FIG. 3). The movement of the unit 13 is designed so that the pressure spring 15, which acts onto the end of the member 16 which is supported by the axle 7 of the release lever 8, moves the member 16, due to its slotlike hole 16', in a direction toward the tip of the ski. Thus, the unit 13 undergoes a movement with respect to the release lever 8 which is composed of a rotation and a transposition or shift, the range of such movement being limited by the stop surfaces 22 and 22'. It is thus possible, even after a release of only the front jaw, to again step into the ski binding with the ski shoe, without first having to manually grasp the release lever 8 and swing it back to the position shown in FIG. 1, because it is still in that position.

Of course, the invention is by no means limited to the exemplary embodiment which is illustrated in the drawings and described above. Variations or modifications thereof, including the rearrangement of parts, are possible without leaving the scope of the invention. For example, it would be possible to use, in place of a compression spring, a cup-spring package in the blind hole of the release lever.

The embodiments of the invention in which an exclusive property or privilege is claimed are defined as follows:

1. A heel holder, comprising a base plate and means for supporting said base plate on a ski, on which base plate a housing is supported, said housing having therein a release spring and a locking member, wherein on a transverse first axle of said housing a unit which has a stepping spur and a down-holding part is supported for pivotal movement about said first axle and for movement approximately radially of said first axle between a first position and a second position radially outward of said first position, said unit being cooperable with a release lever said release lever being pivotally supported on said first axle and having a cam; said locking member being yieldably urged against said cam by said release spring, wherein said unit is pivotable relative to said release lever when said unit is in said second position, is fixed against pivotal movement relative to said release lever when in said first position, is biased by a first spring which urges it to pivot upwardly relative to said release lever, and is biased by a second spring which urges it away from said first axle and said release lever.

2. The heel holder according to claim 1, wherein said unit is supported for said movement relative to said first axle and said release lever by at least one connecting member which has a slotlike opening therein through which said first axle extends, and including a transverse second axle which is provided on said unit and extends through a further opening provided in said connecting member.

3. The heel holder according to claim 2, wherein said connecting member is elongate and said second spring is a compression spring, said second spring and connecting member being disposed in a blind hole provided in said release lever, the axis of second spring being aligned with the axis of said connecting member in the downhill skiing position of the heel holder, said first axle extending transversely through said blind hole and said blind hole, at its outer end, being constructed to permit limited swivelling movement of said connecting member when said second spring has moved said connecting member and said unit to said second position.

4. The heel holder according to claim 1, wherein said unit has a generally planar first surface thereon which can engage a generally planar second surface provided on said release lever, said first transverse axle being rotatably received in bearing eyes provided in projections on said release lever which project outwardly past a plane defined by said second surface, said unit having a recess which can receive said projections on said release lever.

5. The heel holder according to claim 4, wherein said unit has a projection which, in the downhill skiing position of the heel holder, is received in a recess provided in said release lever below said projections on said release lever.

6. The heel holder according to claim 2, including stop surface means provided on said release lever and engageable with at least one of said connecting member and unit for limiting pivotal movement of said unit and said connecting member relative to said release lever.

7. The heel holder according to claim 6, including means for limiting the angle of pivotal movement of said unit relative to said connecting member to approximately 36°, and wherein the angle of pivotal movement of said connecting member relative to said release lever is approximately 72°.

8. The heel holder according to claim 1, wherein said first spring is a torsion spring which is supported on said first axle, one leg of said torsion spring being supported on a stop surface provided on said release lever and the other leg thereof having a bent end which is received in a slotlike recess provided in said unit.

9. The heel holder according to claim 2, wherein said connecting member and said second spring are provided in a central region of said release lever symmetrically with respect to a vertical longitudinal center plane of said heel holder, and wherein two said torsion springs are provided, are laterally spaced from one another, and are located on opposite sides of said connecting member.

10. A heel holder, comprising a base plate and means for supporting said base plate on a ski, on which base plate a housing is supported, said housing having therein a release spring and a locking member, wherein on a transverse axle of said housing a unit which has a stepping spur and a down-holding part is supported for pivotal movement about said axle and for movement approximately radially of said axle between a first position and a second position radially outward of said first position, said unit being cooperable with a release lever said release lever being pivotally supported on said axle and having a cam, said locking member being yieldably urged against said cam by said release spring, wherein said unit is pivotable relative to said release lever when said unit is in said second position, is fixed against pivotal movement relative to said release lever when in said first position, is biased by a torsion spring which urges it to pivot upwardly relative to said release lever, and is biased by a compression spring which urges it away from said axle and said release lever, and wherein said unit has a projection which, in the downhill skiing position, engages a recess provided in said release lever.

11. A heel holder, comprising: a base plate; a housing supported on said base plate; a release member supported on said housing for pivotal movement about a generally horizontal, transverse first axis between a downhill skiing position and a release position; releasable locking means for yieldably resisting pivotal movement of said release member toward said release position when said release member is in said downhill skiing position; a unit having a stepping spur and down-holding part thereon; first means supporting said unit for movement relative to said release member in a direction approximately radially of said first axis between first and second positions, said first position being radially inward of said second position; second means supporting said unit for limited pivotal movement with respect to said release member about a second axis substantially parallel to said first axis when said unit is in said second position; third means for preventing pivotal movement of said unit relative to said release member about said first or second axes when said unit is in said first position, said unit being simultaneously pivotable with said release member about said first axis when in said first position; first resilient means for yieldably urging said unit to pivot upwardly about said second axis relative to said release member; and second resilient means for yieldably urging said unit radially from said first position toward said second position; wherein said second resilient means automatically moves said unit from said first position to said second position when a ski boot releasably held in said heel holder has been removed therefrom without moving said release member from said downhill skiing position to said release position and wherein said first resilient means thereafter pivots said unit upwardly relative to said release member.

12. The heel holder according to claim 11, wherein said housing has a transversely extending axle thereon, wherein said first and second axes are coincident with each other and with said axle, and wherein said first, second and third means includes an opening provided in said release member and extending approximately perpendicular to said axle, said axle extending through said opening, an elongate connecting member having said unit supported on one end and having its other end extending into said opening, said other end of said connecting member having a slotlike opening therein through which said axle extends, movement of said connecting member within said opening in said release member effecting said movement of said unit between said first and second positions, said connecting member being capable of limited pivotal movement within said opening in said release member when said unit is in said second position and said opening in said release member having surfaces which engage said connecting member and prevent pivotal movement thereof relative to said release member when said unit is in said first position.

13. The heel holder according to claim 12, wherein said unit is pivotally supported on said one end of said connecting member.

14. The heel holder according to claim 12, wherein said second resilient means includes a helical compression spring disposed within said opening in said release member on a side of said axle remote from said unit, one end of said spring being supported on said release member and the other end of said spring being supported on said other end of said connecting member.

15. The heel holder according to claim 12, wherein said first resilient means includes a torsion spring which is supported on said axle, has one leg supported on said release member, and has its other leg supported on said unit.

16. The heel holder according to claim 11, wherein one of said unit and said release member has a projection thereon and the other of said unit and said release member has a recess therein, said projection being received in said recess when said unit is in said first position.

17. The heel holder according to claim 11, wherein said release member is a manually operable release lever supported on said housing for pivotal movement about said first axis.

18. The heel holder according to claim 11, wherein said housing is supported on said base plate for pivotal movement about a substantially vertical axis.

19. The heel holder according to claim 11, wherein said releasable locking means includes a cam surface provided on said release member, a locking member supported on said housing for movement toward and away from said cam surface, and third resilient means cooperable with said locking member for yieldably urging said locking member into slidable engagement with said cam surface.

* * * * *